US006503154B2

(12) United States Patent
Maruoka

(10) Patent No.: US 6,503,154 B2
(45) Date of Patent: Jan. 7, 2003

(54) RUBBER THREAD FOR GOLF BALL AND GOLF BALL

(75) Inventor: Kiyoto Maruoka, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/924,683

(22) Filed: Aug. 9, 2001

(65) Prior Publication Data

US 2002/0058554 A1 May 16, 2002

(30) Foreign Application Priority Data

Sep. 20, 2000 (JP) ..... 2000-284855

(51) Int. Cl.[7] ..... A63B 37/06; A63B 37/00; D02G 3/00

(52) U.S. Cl. ..... 473/356; 473/351; 428/377

(58) Field of Search ..... 473/351, 356–366; 525/332.6, 322.7; 428/377, 402.2

(56) References Cited

U.S. PATENT DOCUMENTS 3,880,787 A * 4/1975 Srail ..... 525/124
4,353,557 A 10/1982 Kajita et al.
4,696,475 A 9/1987 Tomita et al.
4,955,966 A * 9/1990 Yuki et al. ..... 473/357
5,037,104 A * 8/1991 Watanabe et al. ..... 260/998.14
5,340,112 A * 8/1994 Hamada et al. ..... 260/998.14
5,346,223 A * 9/1994 Hamada et al. ..... 473/354
5,816,939 A * 10/1998 Hamada et al. ..... 428/364
5,861,465 A * 1/1999 Hamada et al. ..... 473/356

* cited by examiner

*Primary Examiner*—Mark S. Graham
*Assistant Examiner*—Alvin A. Hunter, Jr.
(74) *Attorney, Agent, or Firm*—Birch, Stewart Kolasch & Birch, LLP

(57) ABSTRACT

A golf ball (1) comprises a center (2), a rubber thread layer (3) and a cover (4). The rubber thread layer (3) is formed by winding a drawn rubber thread around the center (2). The rubber thread is obtained by crosslinking a rubber with a sulfur and a vulcanization accelerator. The rubber contains 60% by weight or more of synthetic polyisoprene having a trans 1,4 bond ratio of 2% to 4%. Moreover, the vulcanization accelerator contains 66% by weight or more of a nonbasic vulcanization accelerator and 10% by weight to 30% by weight of an amine type vulcanization accelerator. A weight ratio of an amount of the sulfur to a total amount of the vulcanization accelerator is 0.8/1 to 8/1. The rubber thread rarely causes crystallization during drawing and a thermal deterioration when molding the cover. The golf ball (1) has an excellent resilience performance.

7 Claims, 2 Drawing Sheets

RUBBER THREAD FOR GOLF BALL AND GOLF BALL

BACKGROUND OF THE INVENTION

1. Field of the Invention

The present invention relates to a rubber thread for a golf ball (which will be hereinafter referred to as a "rubber thread") and a golf ball using the rubber thread.

2. Description of the Related Art

A golf ball to be used for a play in a golf course is roughly divided into a wound golf ball having a core in which a rubber thread is wound and a solid golf ball (a two pieces golf ball, a three pieces golf ball and the like) having a core formed of only a solid rubber. In general, the wound golf ball is excellent in a hit feeling and a control performance and the solid golf ball is excellent in a flight distance and a durability. The wound golf ball has been used for a long time. For a certain period, almost all first-class golf balls were represented by the wound golf balls. However, the solid golf ball developed later can be manufactured easily at a low cost. In recent years, therefore, more solid golf balls than the wound golf balls have been put on the market.

Under the circumstances, a professional golf player and an advanced amateur golf player still require the wound golf ball which is excellent in the hit feeling and the control performance. The professional golf player and the advanced amateur golf player have desired the wound golf ball providing a flight distance equivalent to that of a solid golf ball. Moreover, many general amateur golf players want to use the wound golf ball if the flight distance is increased.

The golf ball is launched and flies by hitting with a golf club. In general, if the initial speed of the golf ball is higher immediately after the hitting, a flight distance tends to be increased. Accordingly, it is possible to lengthen the flight distance of the wound golf ball by increasing the initial speed, that is, a resilience coefficient.

An ordinary wound golf ball includes a core and a cover. The core is constituted by a center (a solid center or a liquid center) and a rubber thread layer having a rubber thread drawn and wound around the center. The rubber thread layer most contributes to the resilience performance of the wound golf ball. An attempt to enhance the resilience performance of the wound golf ball has been made by improving the rubber thread to be used for the rubber thread layer for a long period of time. For example, Japanese Patent Publication No. Sho 61-12706 (1986/12706) has disclosed a wound golf ball in which carbon black is used for a rubber composition constituting a rubber thread. Moreover, Japanese Patent Publication No. Hei 5-41272 (1993/41272) has disclosed a wound golf ball in which a specific base rubber issued for a rubber composition constituting a rubber thread.

The rubber thread layer is formed by winding the rubber thread drawn as described above. Usually, a draw ratio is very high, that is, approximately 800% to 1100%. Therefore, the rubber thread is easily crystallized due to the drawing. If the degree of crystallization is high, the resilience performance of the golf ball becomes insufficient. In order to suppress the crystallization, the following means can be supposed.

(1) to increase a ratio of a polysulfide bond in the rubber thread; and (2) to use synthetic polyisoprene having a high ratio of a trans 1,4 bond.

The rubber thread is obtained by crosslinking a rubber. The crosslinking is usually carried out by using a sulfur and a vulcanization accelerator together. By devising the type of the vulcanization accelerator, the ratio of the polysulfide bond can be increased. More specifically, a thiazole type vulcanization accelerator, a basic amine type vulcanization accelerator or the like issued. In the case in which the thiazole type vulcanization accelerator and the amine type vulcanization accelerator are used together, the amine type vulcanization accelerator increases the speed of the crosslink carried out by the thiazole type vulcanization accelerator, thereby contributing to an enhancement in a production efficiency.

The cover is obtained by covering the rubber thread layer with a material such as an ionomer resin. At a covering step, the material is softened at a high temperature and the cover is molded. In this case, the rubber thread is also exposed at a high temperature (for example, 140° C. or more). In some cases, consequently, the rubber thread causes a thermal deterioration. If the thermal deterioration is great, the resilience performance of the golf ball is degraded in spite of the suppression of the crystallization during the drawing.

In consideration of the above-mentioned problems, it is an object of the present invention to provide a rubber thread for a golf ball which rarely causes the crystallization during the drawing and the thermal deterioration when molding the cover and to provide a golf ball using the rubber thread.

SUMMARY OF THE INVENTION

In order to achieve the object, the present invention provides a rubber thread for a golf ball obtained by crosslinking a rubber with a sulfur and a vulcanization accelerator, wherein the rubber contains 60% by weight or more of synthetic polyisoprene having a trans 1,4 bond ratio of 2% to 4%, and the vulcanization accelerator contains 66% by weight or more of a nonbasic vulcanization accelerator.

As described above, an amine type vulcanization accelerator is preferably used for a conventional rubber thread. The present inventor found that a basic vulcanization accelerator such as the amine type vulcanization accelerator causes the promotion of a thermal deterioration and completed the present invention. The nonbasic vulcanization accelerator is used for the rubber thread according to the present. invention and a ratio of the nonbasic vulcanization accelerator to a total vulcanization accelerator is 66% by weight or more (that is, the ratio of the basic vulcanization accelerator is 34% by weight or less). Therefore, the thermal deterioration of the rubber thread can be suppressed. Since the rubber thread is used, the golf ball can have an excellent resilience performance. Although the detailed reason why the basic vulcanization accelerator promotes the thermal deterioration is not clear, it is presumed that a residual functional group of the basic vulcanization accelerator acts as an origin to cut a sulfide bond by heating when molding a cover. It is preferable that a ratio of the nonbasic vulcanization accelerator to a total vulcanization accelerator should be 75% by weight or more.

The amine type vulcanization accelerator also contributes to an enhancement in a polysulfide bond ratio as described above, and furthermore, to the suppression of crystallization during the drawing. In the rubber thread according to the present invention, the amount of the basic vulcanization accelerator (including the amine type vulcanization accelerator) to be blended is controlled. However, the rubber thread contains 60% by weight or more of synthetic polyisoprene having a high trans 1,4 bond ratio, more specifically, syntheticpolyisoprene having a trans 1,4 bond ratio of 2% to 4%. Therefore, the crystallization can also be suppressed sufficiently during the drawing.

It is preferable that the vulcanization accelerator should contain 10% by weight to 30% by weight of the amine type vulcanization accelerator. Consequently, the thermal deterioration can be suppressed when molding the cover, and furthermore, a time required for crosslinking of the rubber thread can be shortened so that the production efficiency of the golf ball can be enhanced. It is preferable that a ratio of the amine type vulcanization accelerator to the total vulcanization accelerator should be 15% by weight to 30% by weight.

It is preferable that a weight ratio of an amount of the sulfur to that of the vulcanization accelerator, that is, a value of (the amount of the sulfur/the amount of the vulcanization accelerator) should be 0.8/1 to 8/1. Consequently, the polysulfide bond ratio in the rubber thread can be maintained almost completely in spite of the control of the amount of the basic vulcanization accelerator to be blended.

The rubber thread is particularly suitable for the golf ball in which the molding temperature of the cover is 140° C. or more. At a step of molding the cover at a high temperature (140° C. or more) which might cause the thermal deterioration, it is possible to remarkably obtain the effect of suppressing the thermal deterioration by a reduction in the amount of the basic vulcanization accelerator to be blended.

The above and further objects and features of the invention will more fully be apparent from the following detailed description with accompanying drawings.

DESCRIPTION OF THE PREFERRED EMBODIMENTS

Figure 1:
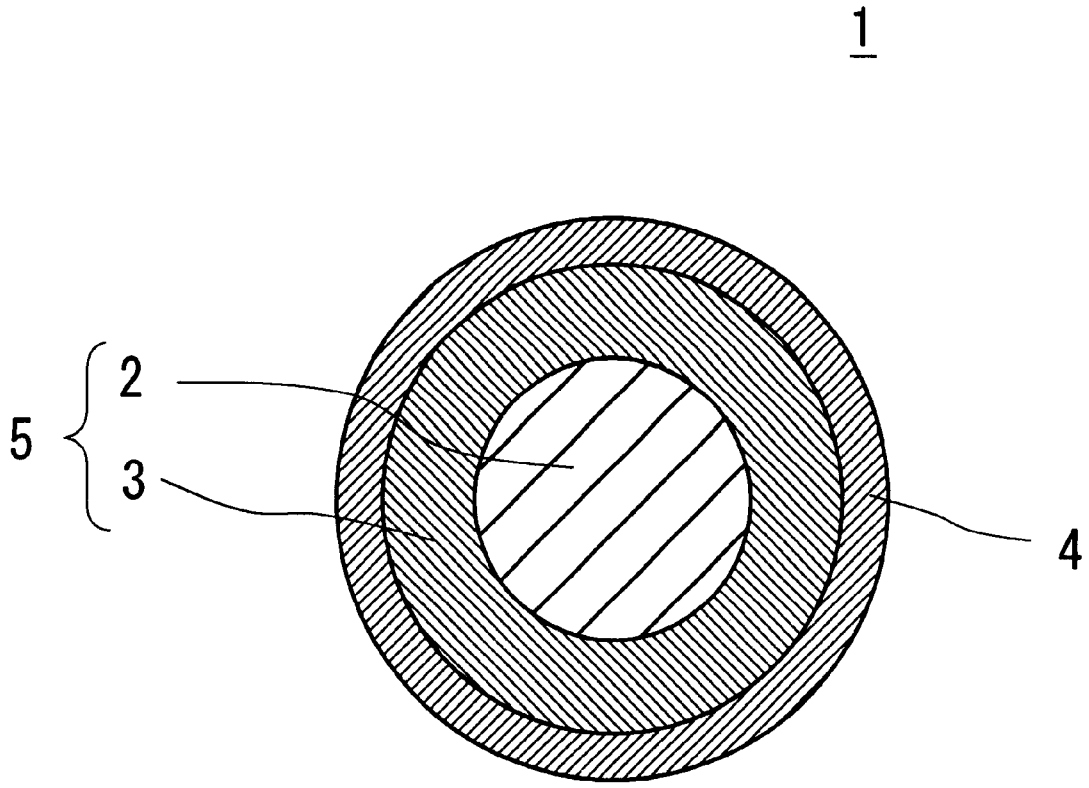
FIG. 1 is a perspective view showing a golf ball according to an embodiment of the present invention.

FIG. 1 is a perspective view showing a golf ball 1 according to an embodiment of the present invention. The golf ball 1 comprises a center 2, a rubber thread layer 3 and a cover 4. The golf ball 1 comprises a mark layer and a coated layer which are provided on the outside of the cover 4, and these layers are not shown. Moreover, the golf ball 1 has dimples on the surface of the cover 4 and the dimples are not shown.

The center 2 is a sphere and is a so-called solid center which is constituted by crosslinking a rubber composition. The type of a rubber to be used for the center 2 is not particularly restricted. Polybutadiene, a natural rubber or the like can be used for the center 2. The center 2 usually has a diameter of approximately 20 mm to 35 mm. In place of the solid center, it is also possible to use a so-called liquid center in which a liquid or a paste-like fluid is filled in a hollow spherical bag formed of a crosslinked rubber.

The rubber thread layer 3 is formed by winding a rubber thread drawn around the center 2. The rubber thread layer 3 includes a rubber thread and a slight gap. During the winding, the rubber thread has a draw ratio of approximately 800% to 1100%. The rubber thread layer 3 usually has a thickness of approximately 1.5 mm to 15 mm. A core 5 is constituted by the center 2 and the rubber thread layer 3.

The cover 4 is provided on the outside of the core 5 in close contact with the rubber thread layer 3. The material of the cover 4 is not particularly restricted. A resin composition using a synthetic resin such as an ionomer resin as a base material or balata is suitably used for the cover 4. The cover 4 usually has a thickness of approximately 1 mm to 4 mm.

Figure 2:
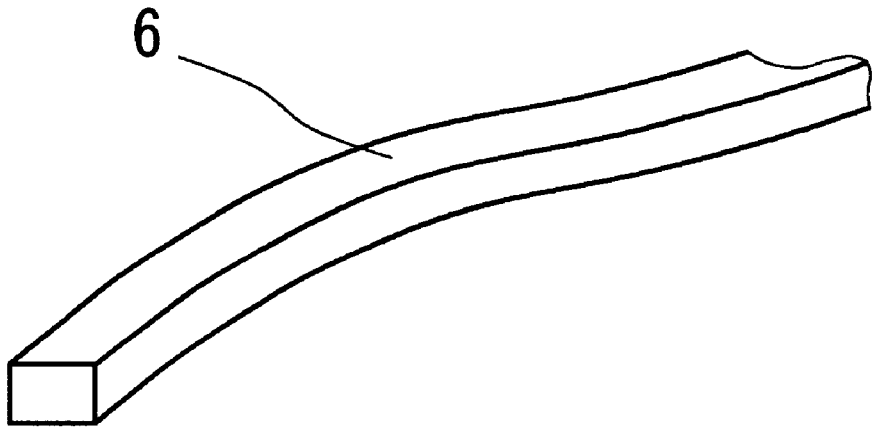
FIG. 2 is a perspective view showing a rubber thread to be used for a rubber thread layer of the golf ball illustrated in FIG. 1.

FIG. 2 is a perspective view showing a rubber thread 6 to be used for the rubber thread layer 3 of the golf ball 1 illustrated in FIG. 1. The rubber thread 6 is obtained by crosslinking a rubber composition. A base rubber of the rubber composition is synthetic polyisoprene. The synthetic polyisoprene contains a trans 1,4 bond. Since the trans 1,4 bond has a three-dimensional structure, the crystallization of a cis 1,4 bond can be prevented during drawing. Another rubber such as a natural rubber or polybutadiene may be used together with the synthetic polyisoprene. Also in the case in which they are used together, a ratio of the synthetic polyisoprene to a total rubber is preferably 60% by weight or more, more preferably 70% by weight or more, and most preferably 80% by weight or more. In respect of the prevention of a thread cut during the drawing, it is preferable that the natural rubber should be mixed in an amount of 10% by weight or less with the synthetic polyisoprene.

The synthetic polyisoprene contains the trans 1,4 bond at a ratio of 2% to 4%. If the ratio is less than 2%, the effect of suppressing the crystallization during the drawing becomes insufficient in some cases. In this respect, it is particularly preferable that the ratio should be 2.5% or more. If the ratio exceeds 4%, the elasticity of the rubber thread 6 is lowered in a stage before the drawing so that the resilience performance of the golf ball 1 becomes insufficient in some cases. In this respect, it is particularly preferable that the ratio should be 3.5% or less. Such synthetic polyisoprene containing a large number of trans 1,4 bonds is generally polymerized with a lithium based catalyst. The ratio of the trans 1,4 bond is measured by a known method through a nuclear magnetic resonance apparatus (NMR).

The rubber is crosslinked by a sulfur and a vulcanization accelerator. The vulcanization accelerator contains 66% by weight or more of a nonbasic vulcanization accelerator (a neutral vulcanization accelerator or an acidic vulcanization accelerator). In other words, a ratio of the basic vulcanization accelerator to a total vulcanization accelerator is 34% by weight or less. The nonbasic vulcanization accelerator rarely promotes a thermal deterioration when molding the cover. If the ratio of the nonbasic vulcanization accelerator is less than 66% by weight, the ratio of the basic vulcanization accelerator is relatively increased so that the rubber thread 6 easily causes the thermal deterioration when molding the cover. In this respect, the ratio of the nonbasic vulcanization accelerator is more preferably 75% by weight or more, and most preferably 85% by weight or more. In respect of the prevention of the thermal deterioration, ideally, the ratio of the nonbasic vulcanization accelerator is 100% by weight, that is, the basic vulcanization accelerator is not blended at all.

Examples of the nonbasic vulcanization accelerator include a thiazole type vulcanization accelerator, a sulfenamide type vulcanization accelerator, a thiuram type vulcanization accelerator, a dithiocarbamate type vulcanization accelerator, a xanthate type vulcanization accelerator and the like. In particular, the thiazole type vulcanization accelerator and the sulfenamide type vulcanization accelerator are suitable for an increase in the ratio of a polysulfide bond. Specific examples of the thiazole type vulcanization accelerator include 2-mercaptobenzothiazole (for example, trade name of "Nocceler M" produced by Ouchi Shinko Chemical Industrial Co., Ltd.), dibenzothiazyldisulfide (for example, trade name of "Nocceler DMP" produced by Ouchi Shinko Chemical Industrial Co., Ltd.), and the like. Specific examples of the sulfenamide type vulcanization accelerator include N-cyclohexyl-2-benzothiazolylsulfenamide (for example, trade name of "Nocceler CZ" produced by Ouchi Shinko Chemical Industrial Co., Ltd.), N-tert-butyl-2-benzothiazolylsulfenamide (for example, trade name of "Nocceler NS" produced by Ouchi Shinko Chemical Industrial Co., Ltd.), and the like. Specific examples of the thiuram type vulcanization accelerator include tetraethylthiuramdisulfide (for example, trade name of "NoccelerTET" produced by Ouchi Shinko Chemical Industrial Co., Ltd.), tetrabutylthiuramdisulfide (for example, trade name of "Nocceler TBT" produced by Ouchi Shinko Chemical Industrial Co., Ltd.), and the like.

On the other hand, examples of the basic vulcanization accelerator include a guanidine type vulcanization accelerator, an aldehydeamine type vulcanization accelerator, an aldehydeammonia type vulcanization accelerator and the like. Specific examples of the guanidine type vulcanization accelerator include 1,3-diphenylguanidine (for example, trade name of "Nocceler D" produced by Ouchi Shinko Chemical Industrial Co., Ltd.), di-o-tolylguanidine (for example, trade name of "Nocceler DT" produced by Ouchi Shinko Chemical Industrial Co., Ltd.), and the like. Specific examples of the aldehydeamine type vulcanization accelerator include n-butylaldehydeaniline (for example, trade name of "Nocceler 8" produced by Ouchi Shinko Chemical Industrial Co., Ltd.), and the like.

For the vulcanization accelerator, an amine type vulcanization accelerator (which is a kind of basic vulcanization accelerator) may be used with the ratio of the nonbasic vulcanization accelerator within the above-mentioned range. By the use of the amine type vulcanization accelerator, a crosslinking speed is increased so that the production efficiency of the golf ball 1 can be enhanced. It is preferable that a ratio of the amine type vulcanization accelerator to the total vulcanization accelerator should be 10% by weight to 30% by weight If the ratio is less than 10% by weight, the effect of enhancing a vulcanization speed becomes insufficient in some cases. In this respect, it is particularly preferable that the ratio should be15%by weight or more. If the ratio is more than30% by weight, the thermal deterioration of the rubber thread 6 is promoted when molding the cover in some cases. In this respect, it is particularly preferable that the ratio should be 25% by weight or less.

In the rubber thread 6 obtained by crosslinking a rubber with the sulfur and the vulcanization accelerator, there are a polysulfide bond (including a disulfide bond) in which rubber molecules are crosslinked with two or more sulfurs and a monosulfide bond in which the rubber molecules are crosslinked with one sulfur. A monosulfide bonding portion easily causes the crystallization if the rubber thread 6 is drawn. To the contrary, the polysulfide bonding portion rarely causes the crystallization by the drawing. Accordingly, if the ratio of the polysulfide bond to a total bonding amount is high, the crystallization is suppressed so that the hysteresis loss of the rubber thread 6 is reduced and the resilience performance of the golf ball can be enhanced. More specifically, the ratio of the polysulfide bond to the total bonding amount is preferably 70% or more, and particularly preferably 95% or more.

A ratio (R) of the polysulfide bond is calculated by the following equation (I):

$$R=\nu_P/\nu_T \tag{I}$$

wherein a total crosslinking density is represented by ($\nu_T$) and a crosslinking density of the polysulfide bond is represented by ($\nu_P$).

The crosslinking density ($\nu_P$) of the polysulfide bond is calculated by the following equation (II):

$$\nu_P=\nu_T-\nu_M \tag{II}$$

wherein a crosslinking density of the monosulfide bond is represented by ($\nu_M$).

The crosslinking density is calculated in the following procedure. First of all, a columnar specimen having a diameter of 3 mm is punched out of a crosslinked rubber sheet which has not yet been cut into the rubber thread 6. The specimen is immersed in acetone at 20° C. for 24 hours so that oil and an antioxidant are extracted. The specimen obtained after the extraction is immersed and swollen, for 24 hours, in a solvent at 20° C. in which tetrahydrofuran (THF) and benzene are mixed with a weight ratio of 1:1. Next, the specimen is put in a TMA apparatus filled with the solvent at 20° C. in which tetrahydrofuran and benzene are mixed with a weight ratio of 1:1. A value of ($\tau_0/(1/\alpha^2-\alpha)$) is calculated based on a relationship between a compression stress and a strain in the TMA apparatus. A numeric value thus obtained and various dimensions of the specimen are substituted for Flory's theoretical equation expressed in the following equation (III) so that the total crosslinking density ($\nu_T$) of the rubber thread 6 is calculated. A test is carried our for three specimens and the results thus obtained are averaged.

$$\gamma_T=\frac{\gamma e'}{V0'}=\frac{\tau_0}{RT\left(\alpha-\frac{1}{\alpha^2}\right)}\sqrt[3]{\frac{1-\phi}{(Ls0/L0)^3-\phi}} \tag{V}$$

$\tau_0$: stress=f/AO [g/mm$^2$]

f: load [g]

γe: number of crosslinked points [number]

γe': number of crosslinked points [mol]

K: Boltzmann constant $1.381\times10^{-23}$ [J/K]

R: gas constant 8.314 [J/mol·K]→R=kNa (Na:avogadro's number=$6.02\times10^{-23}$ mol$^{-1}$)

T: measuring temperature [K]

VO: total volume of specimen [mm$^3$]

VO': volume of pure rubber polymer=VO (1−ϕ) [mm$^3$]

ϕ: volume fraction of filler(volume of filler/total volume of rubber)

α: compression ratio of specimen after swelling=Ls/Ls0

L0: height of specimen before swelling [mm]

Ls: height of compressed and swollen specimen [mm]

Ls0: height of specimen after swelling [mm]

A0: area of end face of specimen before swelling [mm$^2$]

A1: area of end face of specimen after swelling=A0 (LS0/L0) [mm$^2$]

$\tau_0$ can be calculated by the following equation.

$$\tau_0=\frac{RT\gamma e'}{V0'}\sqrt[3]{\frac{(Ls0/L0)^3-\phi}{1-\phi}\left(\alpha-\frac{1}{\alpha^2}\right)}$$

The measurement for calculating the crosslinking density ($\nu_M$) of the monosulfide bond is carried out in the same manner as that of the crosslinking density ($\nu_T$) except that a LiAlH catalyst is added to a 1:1 mixed solution of tetrahydrofuran and benzene to swell the specimen. The crosslinking density ($\nu_M$) is calculated in accordance with the equation (III). In this case, ($\nu_T$) in the equation (III) is replaced with ($\nu_M$).

It is preferable that the weight ratio of the amount of the sulfur to that of the vulcanization accelerator, that is, (the amount of the sulfur/the amount of the vulcanization accelerator) should be 0.8/1 to 8/1. If the value is less than 0.8/1, the ratio of the monosulfide bond in the rubber thread 6 is increased (that is, the ratio of the polysulfide bond is reduced) so that the crystallization is promoted during the drawing in some cases. In this respect, the value is more preferably 1/1 or more, and most preferably 2/1 or more. If the value is more than 8/1, various physical properties of the w rubber thread 6 are deteriorated due to blooming in some cases. In this respect, the value is more preferably 5/1 or less, and most preferably 4/1 or less.

It is preferable that the amount of the sulfur to be blended should be 0.5 to 7 parts by weight for 100 parts by weight of a rubber. In some cases in which the amount of the sulfur to be blended is less than 0.5 part by weight, the crosslinking density of the rubber thread 6 is reduced so that a tensile strength becomes insufficient. In this respect, it is particularly preferable that the amount of the sulfur to be blended should be 1.0 part by weight or more. When the amount of the sulfur to be blended is more than 7 parts by weight, an elongation at break (EB) of the rubber thread 6 is reduced so that sufficient drawing is hard to carry out during winding in some cases. From this viewpoint, it is particularly preferable that the amount of the sulfur to be blended should be 4 parts by weight or less.

It is preferable that the amount of the vulcanization accelerator to be blended should be 0.3 to 3 parts by weight for 100 parts by weight of the rubber. In some cases in which the amount of the vulcanization accelerator to be blended is less than 0.3 part by weight, the crosslinking density of the rubber thread 6 is reduced so that a tensile strength becomes insufficient. In this respect, it is particularly preferable that the amount of the vulcanization accelerator to be blended should be 0.5 part by weight or more. If the amount of the vulcanization accelerator to be blended is more than 3 parts by weight, an elongation at break (EB) of the rubber thread 6 is reduced so that sufficient drawing is hard to carry out during the winding in some cases. From this viewpoint, it is particularly preferable that the amount of the vulcanization accelerator to be blended should be 2 parts by weight or less.

For a rubber composition to be used for the rubber thread 6, zinc oxide or the like may be blended as an activator in addition to the sulfur and the vulcanization accelerator, and furthermore, a proper amount of a filler such as clay, a softening agent such as oil, an antioxidant, other additives or the like may be blended.

Preferably, the thickness of the rubber thread 6 is 0.35 mm to 0.6 mm, and more preferably, 0.4 mm to 0.55 mm. If the thickness is less than the above-mentioned range, thread cutting maybe caused easily during the drawing. If the thickness exceeds the same range, the rubber thread 6 is stretched with difficulty during winding, so that the density of the rubber thread 6 in the core 5 is reduced in some cases. The golf ball 1 using the core 5 with the small density of the rubber thread 6 has a low hardness and a poor resilience performance. The thickness of the rubber thread 6 may be measured in the stage of a crosslinked rubber sheet for convenience.

It is preferable that the rubber thread 6 should be obtained through a kneading step, an extruding step, a crosslinking step and a cutting step. At the kneading step, first of all, a rubber, a crosslinking agent, an additive and the like are kneaded so that a rubber composition is obtained. An internal kneading machine such as a kneader or a Banbury mixer, an open roll and the like are used for the kneading.

At the extruding step, next, the rubber composition obtained at the kneading step is put into a cylinder of an extruder and is extruded from a die of a head portion. An opening of the die is slit-shaped and the rubber composition is extruded like a sheet. The thickness of the uncrosslinked rubber sheet is usually reduced through a roller processing or the like. In respect of productivity, it is preferable that a roller head extruder should be used and the extrusion and the roller processing should be carried out in a single pass. It is a matter of course that the thickness can be reduced at a calendaring step after the extrusion.

At the crosslinking step, the uncrosslinked rubber sheet is crosslinked. It is preferable that the crosslinking should be carried out through a continuous crosslinking device. The continuous crosslinking device comprises a heat roller and a belt pressed in contact with the heat roller. The uncrosslinked rubber sheet is inserted between the heat roller and the belt. The uncrosslinked rubber sheet is pressurized and heated to cause a crosslinking reaction. By using the continuous crosslinking device, a surface roughness of the crosslinked rubber sheet is reduced. Examples of the continuous crosslinking device include a Rote-Cure type device manufactured by Adamson Co., Ltd. in U.S.A., and an AUMA type device manufactured by Berstorff Co., Ltd. in Germany. In the continuous crosslinking device, the uncrosslinked rubber sheet is always crosslinked while abutting on the heat roller. Differently from the case in which the uncrosslinked rubber sheet is wound onto the roller in many plies and is crosslinked by a vulcanizer, a variation in the physical property is not caused by a difference in a heat conductivity between an inside sheet and an outside sheet. It is a matter of course that the crosslinked rubber sheet may be obtained through the vulcanizer or the like.

The crosslinked rubber sheet is cut to have a predetermined width at the cutting step. A well-known cutter can be used for the cutting. Thus, the rubber thread 6 can be obtained. The rubber thread 6 is wound upon the center 2 so that the core 5 is obtained. On the other hand, a semispherical half shell containing an ionomer resin, polyester, polyurethane, balata or the like as a principal component is molded. Two half shells are bonded to the core 5. The core 5 is put, together with the half shells, in a mold including upper and lower parts having semispherical cavities respectively, and is pressurized and heated to mold the cover 4. It is a matter of course that the cover 4 may be molded by an injection molding method. Even if the molding temperature of the cover 4 is high, that is, 140° C. or more, the thermal deterioration of the rubber thread 6 can be suppressed because the rubber thread 6 is formed of a rubber composition containing the nonbasic vulcanization accelerator in a large amount.

EXAMPLES

Example 1

85 parts by weight of synthetic polyisoprene containing 3% of a trans 1,4 bond and 92% of a cis 1,4 bond (trade name of "IR309" produced by Shell Co., Ltd.), 15 parts by weight of a natural rubber (pale crepe), 0.5 part by weight of zinc oxide (trade name of "zinc oxide No. 1" produced by Sakai Chemical Industry Co., Ltd.), 1 part by weight of 2,6-di-tert-butyl-4-methylphenol as an antioxidant (trade name of "Nocrac 200" produced by Ouchi Shinko Chemical Industrial Co., Ltd.), 3.0 parts by weight of a sulfur, 0.2 part by weight of 1,3-diphenylguanidine as an amine type vulcanization accelerator (trade name of "Nocceler D" produced by Ouchi Shinko Chemical Industrial Co., Ltd.), and 0.7 part by weight of dibenzothiazyldisulfide as a nonbasic vulcanization accelerator (trade name of "Nocceler DMP" produced by Ouchi Shinko Chemical Industrial Co., Ltd.) were put and kneaded in a kneader. Thus, a rubber composition was prepared.

The rubber composition was formed like a ribbon and was put in a cylinder of a roller head extruder. The rubber composition was extruded from a head portion including a die having a thickness of 4 mm and a width of 200 mm. Consequently, an uncrosslinked rubber sheet having a width of 300 mm and a thickness of 0.5 mm was obtained. During the extrusion, a temperature in the cylinder was set to 70° C., a temperature in the head portion was set to 90° C., a temperature in the roll was set to 90° C., and the speed of rotations of a screw was set to 20 rpm.

The uncrosslinked rubber sheet was continuously crosslinked by using the continuous crosslinking device (the Rote-Cure type device manufactured by the Adamson Co., Ltd. in U.S.A.). Thus, a crosslinked rubber sheet was obtained. A crosslinking temperature was set to 150° C., a pressure was set to 0.2 MPa and a crosslinking time was set to 7 minutes. The crosslinked rubber sheet was cut to have a width of 2 mm. Thus, a rubber thread was obtained.

On the other hand, 100 parts by weight of polybutadiene (trade name of "BR01" produced by JSR Co., Ltd.), 5 parts by weight of zinc oxide (the above-mentioned "zinc oxide No. 1"), 75 parts by weight of barium sulfate, 0.2 part by weight of N-cyclohexyl-2-benzothiazolyl sulfenamide as a sulfenamide type vulcanization accelerator (trade name of "Nocceler CZ" produced by Ouchi Shinko Chemical Industrial Co., Ltd.), and 9 parts by weight of a sulfur were put and kneaded in a kneader. Thus, a rubber composition was prepared. The rubber composition was put in a mold including upper and lower parts having semispherical cavities respectively, and was crosslinked at 150° C. for 30 minutes. Thus, a center having a diameter of 32 mm was obtained. A rubber thread was drawn and wound around the center to have a draw ratio of 1000%. Thus, a core having a diameter of 39 mm was obtained.

A resin composition containing 50 parts by weight of an ionomer resin (trade name of "Himilan 1605" produced by Du Pont-Mitsui Polychemicals Company, Ltd.), 50 parts by weight of another ionomer resin (trade name of "Himilan 1652" produced by Du Pont-Mitsui Polychemicals Company, Ltd.) and 2 parts by weight of titanium oxide was used to mold a semispherical half shell having a thickness of 2 mm by an injection molding method. Two half shells were bonded to a core. The core was put in a mold including upper and lower part shaving semispherical cavities respectively, and was pressurized and heated for 3 minutes at 160° C., thereby molding a cover. The cover was coated by a well-known method. Thus, a golf ball according to an example 1 was obtained.

Example 2 and Comparative Example 1

A golf ball according to each of an example 2 and a comparative example 1 was obtained in the same manner as in the example 1 except that the amounts of a rubber and a vulcanization accelerator which are to be blended were varied as shown in the following Table 1.

Examples 3 and 4 and Comparative Example 2

A golf ball according to each of examples 3 and 4 and a comparative example 2 was obtained in the same manner as in the example 1 except that the amount of a vulcanization accelerator to be blended was varied as shown in the following Table 1.

Comparative Examples 3 and 4

A golf ball according to each of comparative examples 3 and 4 was obtained in the same manner as in the example 1 except that N-cyclohexyl-2-benzothiazolylsulfenamide (the above-mentioned "Nocceler CZ") to be another nonbasic vulcanization accelerator was used in place of the Nocceler DMP and the amount of a vulcanization accelerator to be blended was varied as shown in the following Table 1.

Examples 5 and 6

A golf ball according to each of examples 5 and 6 was obtained in the same manner as in the example 1 except that the amounts of a sulfur and a vulcanization accelerator which are to be blended were varied as shown in the following Table 1.

Example 7

A golf ball according to an example 7 was obtained in the same manner as in the example 1 except that N-cyclohexyl-2-benzothiazolylsulfenamide (the above-mentioned "Nocceler CZ", nonbasic vulcanization accelerator) was used in place of the Nocceler DMP and the amounts of a sulfur and a vulcanization accelerator which are to be blended were varied as shown in the following Table 1.

Measurement of Resilience Coefficient of Ball

A hollow cylinder formed of aluminum having a weight of 200 g was caused to collide with each golf ball at a speed of 40 m/s. The speed of the hollow cylinder before and after the collision and the speed of the golf ball after the collision were measured. Thus, the resilience coefficient of the golf ball was obtained in accordance with the law of momentum preservation. A mean value obtained by the measurement for 10 golf balls is shown in the following Table 1.

Measurement of Amount of Compressive and Deformation

First of all, an initial load of 98N was applied to the core, and a load was gradually increased and a final load of 1274N was then applied. The amount of deformation of the core was measured from the initial load to the final load. By the same method, the amount of deformation of the golf ball was also measured. A value calculated by subtracting the amount of deformation of the golf ball from the amount of deformation of the core was set to be a "difference in an amount of compressive deformation". For the amounts of deformation of the core and the golf ball, a mean value obtained by the measurement for 10 samples was used. The result is shown in the following table 1.

Measurement of Vulcanization Time

A rubber composition using each rubber thread was subjected to a vulcanization test through a vulcanization measuring machine (trade name of Type III Curast produced by Orientech Co., Ltd.) to obtain a vulcanization curve. Then, T90 was obtained and 3 minutes are added thereto. A value thus obtained was set to be the vulcanization time. The result is shown in the following Table 1.

TABLE 1

| | Result of Evaluation | | | | | | | | | | |
|---|---|---|---|---|---|---|---|---|---|---|---|
| | Com. Example 1 | Example 2 | Com. Example 2 | Example 1 | Example 3 | Example 4 | Com. Example 3 | Com. Example 4 | Example 5 | Example 6 | Example 7 |
| Synthetic polyisoprene | 50 | 70 | 85 | 85 | 85 | 85 | 85 | 85 | 85 | 85 | 85 |
| Natural rubber | 50 | 25 | 15 | 15 | 15 | 15 | 15 | 15 | 15 | 15 | 15 |
| Zinc oxide | 0.5 | 0.5 | 0.5 | 0.5 | 0.5 | 0.5 | 0.5 | 0.5 | 0.5 | 0.5 | 0.5 |
| Antioxidant | 1 | 1 | 1 | 1 | 1 | 1 | 1 | 1 | 1 | 1 | 1 |
| Sulfur | 3.0 | 3.0 | 3.0 | 3.0 | 3.0 | 3.0 | 3.0 | 3.0 | 1.15 | 1.0 | 1.0 |
| Amine type vulcanization accelerator D | 0.2 | 0.2 | 0.5 | 0.2 | 0.2 | 0.1 | 0.7 | 0.5 | 0.3 | 0.3 | — |
| Nonbasic vulcanization accelerator DMP | 1.0 | 0.7 | 0.7 | 0.7 | 1.0 | 0.7 | — | — | 0.7 | 1.0 | 0.5 |
| Nonbasic vulcanization accelerator CZ | — | — | — | — | — | — | 0.2 | 0.5 | — | — | 0.5 |
| Ratio of nonbasic vulcanization accelerator (% by weight) | 83 | 78 | 58 | 78 | 83 | 87 | 22 | 50 | 70 | 77 | 100 |
| Ratio of amine type vulcanization accelerator (% by weight) | 17 | 22 | 42 | 22 | 17 | 13 | 78 | 50 | 30 | 23 | 0 |
| Amount of sulfur/Amount of vulcanization accelerator | 2.5 | 3.3 | 3.3 | 3.3 | 2.5 | 3.8 | 3.3 | 3.0 | 1.15 | 0.77 | 3.0 |
| Resilience coefficient of ball | 0.7869 | 0.8014 | 0.7952 | 0.8096 | 0.8189 | 0.8157 | 0.7861 | 0.7910 | 0.8060 | 0.8074 | 0.8228 |
| Amount of compressive deformation of core (mm) A | 2.66 | 2.69 | 2.61 | 2.72 | 2.66 | 2.75 | 2.65 | 2.68 | 2.71 | 2.77 | 2.69 |
| Amount of compressive deformation of ball (mm) B | 2.71 | 2.74 | 2.96 | 2.77 | 2.65 | 2.73 | 3.25 | 3.06 | 2.81 | 2.82 | 2.5 |
| Difference (mm) A − B | −0.05 | −0.05 | −0.35 | −0.05 | +0.01 | +0.02 | −0.60 | −0.38 | −0.10 | −0.05 | +0.10 |
| Vulcanization time (min) | 9 | 9 | 7 | 9 | 9 | 14 | 7 | 8 | 7 | 7 | 30 |

In the Table 1, the resilience coefficient of the golf ball according to the comparative example 1 is low because the amount of the synthetic polyisoprene to be blended is small. Moreover, the resilience coefficient of the golf ball according to each of the comparative examples 2, 3 and 4 is low because the ratio of the nonbasic vulcanization accelerator is low and that of the amine type vulcanization accelerator is high so that the rubber thread causes a thermal deterioration when molding a cover. On the other hand, the golf ball according to each of the examples in which the amount of the synthetic polyisoprene to be blended is 60% by weight or more and the ratio of the nonbasic vulcanization accelerator to a total vulcanization accelerator is 66% by weight or more has an excellent resilience performance. From the results of evaluation, the advantage of the present invention is apparent.

The above description is only illustrative and various changes can be made without departing from the scope of the present invention.

What is claimed is:

1. A rubber thread for a golf ball obtained by crosslinking a rubber with a sulfur and a vulcanization accelerator, wherein the rubber contains 60% by weight or more of synthetic polyisoprene having a trans 1,4 bond ratio of 2% to 4%, and the vulcanization accelerator contains 66% by weight or more of a nonbasic vulcanization accelerator.

2. The rubber thread for a golf ball according to claim 1, wherein a ratio of the nonbasic vulcanization accelerator to a total vulcanization accelerator is 75% by weight or more.

3. The rubber thread for a golf ball according to claim 1, wherein the vulcanization accelerator contains 66% by weight or more of the nonbasic vulcanization accelerator and 10% by weight to 30% by weight of an amine type vulcanization accelerator.

4. The rubber thread for a golf ball according to claim 3, wherein a ratio of the amine type vulcanization accelerator to a total vulcanization accelerator is 15% by weight to 30% by weight.

5. The rubber thread for a golf ball according to claim 1, wherein a weight ratio of an amount of the sulfur to a total amount of the vulcanization accelerator is 0.8/1 to 8/1.

6. A golf ball comprising a center, a rubber thread layer and a cover, wherein a rubber thread constituting the rubber thread layer is obtained by crosslinking a rubber containing 60% by weight or more of synthetic polyisoprene having a trans 1,4 bond ratio of 2% to 4% with a sulfur and a vulcanization accelerator containing 66% by weight or more of a nonbasic vulcanization accelerator.

7. The golf ball according to claim 6, wherein the cover is molded at a temperature of 140° C. or more.

* * * * *